US008250878B2

(12) United States Patent
Kinkel

(10) Patent No.: US 8,250,878 B2
(45) Date of Patent: Aug. 28, 2012

(54) AIR CONDITIONING AND ENERGY RECOVERY SYSTEM AND METHOD OF OPERATION

(75) Inventor: Stephen Kinkel, Phoenix, AZ (US)

(73) Assignee: United Metal Products, Inc., Tempe, AZ (US)

( * ) Notice: Subject to any disclaimer, the term of this patent is extended or adjusted under 35 U.S.C. 154(b) by 826 days.

(21) Appl. No.: 12/411,283

(22) Filed: Mar. 25, 2009

(65) Prior Publication Data

US 2009/0241564 A1 Oct. 1, 2009

Related U.S. Application Data

(63) Continuation-in-part of application No. 12/203,498, filed on Sep. 3, 2008.

(60) Provisional application No. 61/040,013, filed on Mar. 27, 2008.

(51) Int. Cl.
*F25B 7/00* (2006.01)

(52) U.S. Cl. ..... 62/335

(58) Field of Classification Search ..... 62/324.1, 62/93, 335, 515
See application file for complete search history.

(56) References Cited

U.S. PATENT DOCUMENTS 5,003,961 A 4/1991 Besik
5,548,970 A * 8/1996 Cunningham et al. ..... 62/271
5,579,647 A * 12/1996 Calton et al. ..... 62/94
5,664,433 A 9/1997 Bourne et al.
5,953,926 A 9/1999 Dressler et al.
6,338,254 B1 * 1/2002 Alsenz ..... 62/79
6,915,656 B2 * 7/2005 Ratliff ..... 62/324.6
6,931,883 B2 8/2005 Bourne et al.
7,128,138 B2 10/2006 Des Champs
7,143,597 B2 12/2006 Hyland et al.
2003/0192331 A1 10/2003 Alford
2006/0144576 A1 7/2006 Des Champs
2007/0017241 A1 1/2007 Hyland et al.

OTHER PUBLICATIONS

Premier Industries, Inc., Indirect/Direct Cooling Unit, Mar. 3, 2009, http://www.piec.com/inddir.htm.

* cited by examiner

*Primary Examiner* — Melvin Jones
(74) *Attorney, Agent, or Firm* — Meschkow & Gresham, P.L.C.

(57) ABSTRACT

A system (20) for conditioning air (30) includes conditioning circuits (26, 28). Each of the circuits (26, 28) includes a heat transfer coil (54, 60) residing in a supply section (22) of the system (20), and a heat transfer coil (56, 62) residing in a return section (24) of the system (20). A controller (50) in communication with the circuits (26, 28) determines one of a heating mode (78, 110) and a cooling mode (148, 150) for an interior space (34). The controller (50) selectively actuates the conditioning circuits (26, 28) to condition outside air (30) entering the supply section (22) to produce conditioned supply air (36) for provision into space (34) and to recover heating and cooling energy from return air (38) entering the return section (24) from the space (34) prior to its discharge from the system (20) as exhaust air (44). An additional cooling circuit (218) residing in a cooling section (214) preconditions outside air (30) by reducing the temperature of outside air (30) before supply section (22) of system (20) conditions outside air (30) for interior space (34).

24 Claims, 10 Drawing Sheets

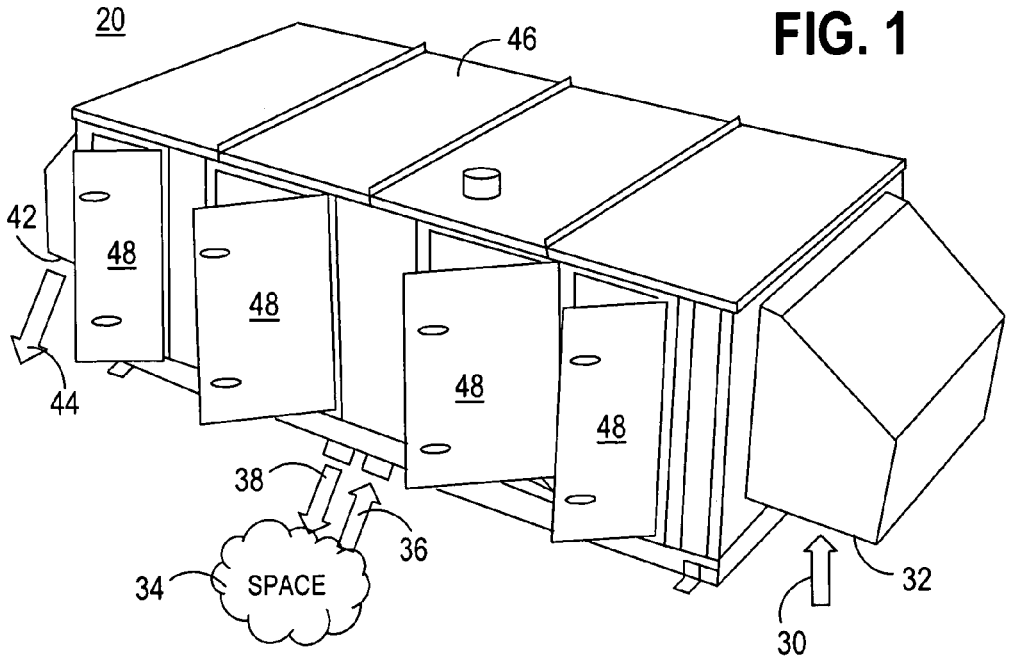
FIG. 1
FIG. 2
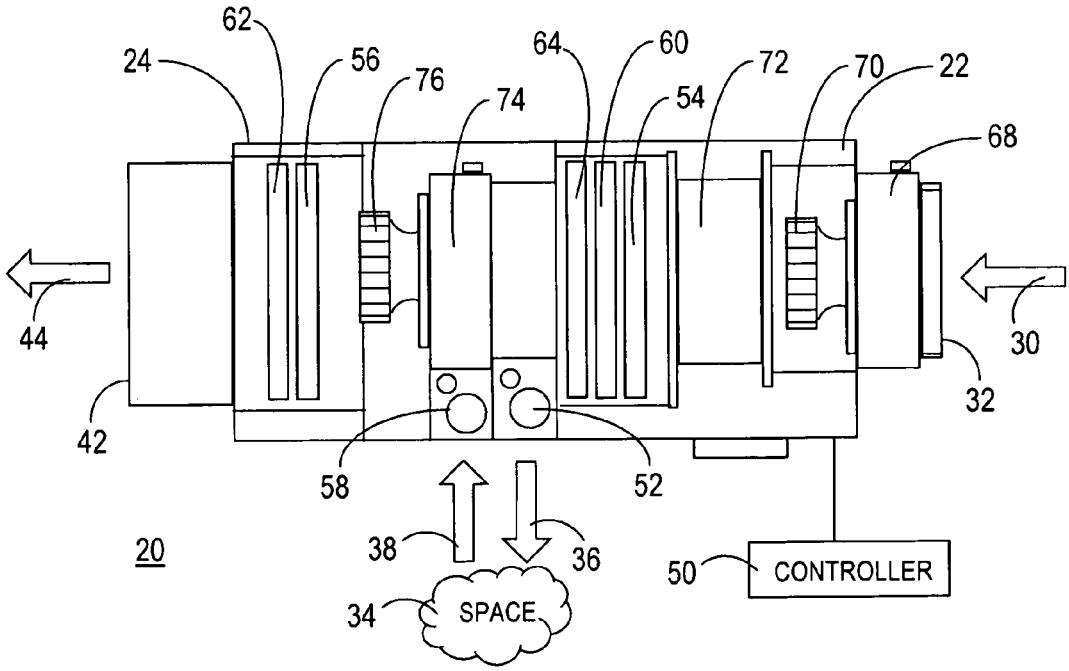

CIRCUIT A—HEATING MODE

CIRCUIT B—HEATING MODE

CIRCUIT A—COOLING MODE

CIRCUIT B—COOLING MODE

CIRCUIT B—DEHUMIDIFICATION MODE

AIR CONDITIONING AND ENERGY RECOVERY SYSTEM AND METHOD OF OPERATION

RELATED INVENTION

The present invention claims priority under 35 U.S.C. §119(e) to: "Indirect/Direct Evaporative Cooling Unit," U.S. Provisional Application Ser. No. 61/040,013, filed 27 Mar. 2008, which is incorporated by reference herein.

The present invention is a continuation in part (CIP) of "Air Conditioning and Energy Recovery System and Method of Operation," U.S. patent application Ser. No. 12/203,498, filed 3 Sep. 2008, which is incorporated by reference herein.

TECHNICAL FIELD OF THE INVENTION

The present invention relates to the field of air conditioning systems. More specifically, the present invention relates to an air conditioning system that includes an energy recovery capability.

BACKGROUND OF THE INVENTION

Dependence on the natural exchange of air between the indoors and outdoors through air infiltration and exfiltration may not be satisfactory for good indoor air quality and moisture control. Accordingly, mechanical ventilation systems have been developed that use fans to maintain a flow of fresh outdoor air into a building (outside air stream) while exhausting out an equal amount of stale indoor air (exhaust air stream).

Unfortunately, these ventilation systems place additional burdens on the heating, ventilating, and air conditioning systems of a building. In particular, costly conditioned air is exhausted (along with contaminants) as the exhaust air stream, while the outside air stream must be brought in and conditioned (cooled, heated, and/or dehumidified) in order to provide a healthy environment in the building. Furthermore, these ventilation systems result in the loss of heating or cooling energy in the exhaust air. The problem of losing heating or cooling energy through the air exhausted from a building or facility has had a major impact in the form of wasted energy and high costs for heating, ventilating, and cooling buildings, institutions, and facilities.

This problem is exacerbated in commercial facilities and institutions that require nearly one hundred percent outside air at high ventilation rates. A pet store, veterinarian's office, or gymnasium represents a few of such facilities, but similar requirements are presented in other applications as well. The heating and cooling energy needed to condition this air, as well as the fan energy needed to move it, can be prohibitively costly. Moreover, with the high percentage of outdoor air mandated for commercial and institutional buildings, controlling indoor humidity levels can become a challenge.

Strategies for recovering at least a portion of this wasted energy have concentrated on separate systems and methods for recovering the lost heating or cooling energy through cross flow exchangers, run-around loops, heat wheels, heat pipes, and so forth. Each of these strategies try to scavenge the maximum amount of heating or cooling energy from the exhaust air stream and return that energy to precondition the supply air. These systems, typically referred to as energy recovery ventilators, have generally been implemented in the colder regions of the United States, Canada, Europe, and Scandinavia.

In warm areas, there is not a significant energy dollar savings from using energy recovery ventilators since they are not as effective in the cooling season and they can be quite costly. That is, the cost of the additional electricity consumed by the system fans may exceed the energy savings from not having to condition the supply air in mild climates. Nevertheless, pollutants generated in a building, facilities, or institutions can accumulate and reduce the indoor air quality to unhealthful levels. In addition, regulations governing commercial facilities and institutions that require nearly one hundred percent outside air at high ventilation rates still apply in these warm areas.

Accordingly what is needed is a system and method for ensuring a healthy indoor environment and positive moisture control for an interior space in a variety of climates. What is further needed is a system and method for energy recovery that enable a facility's heating and cooling system to be downsized through lost energy recovery.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

FIG. 1 shows a perspective view of an air conditioning and energy recovery system in accordance with an embodiment of the invention;

FIG. 2 shows a plan view of the system of FIG. 1;

DETAILED DESCRIPTION OF THE PREFERRED EMBODIMENTS

Figure 3:
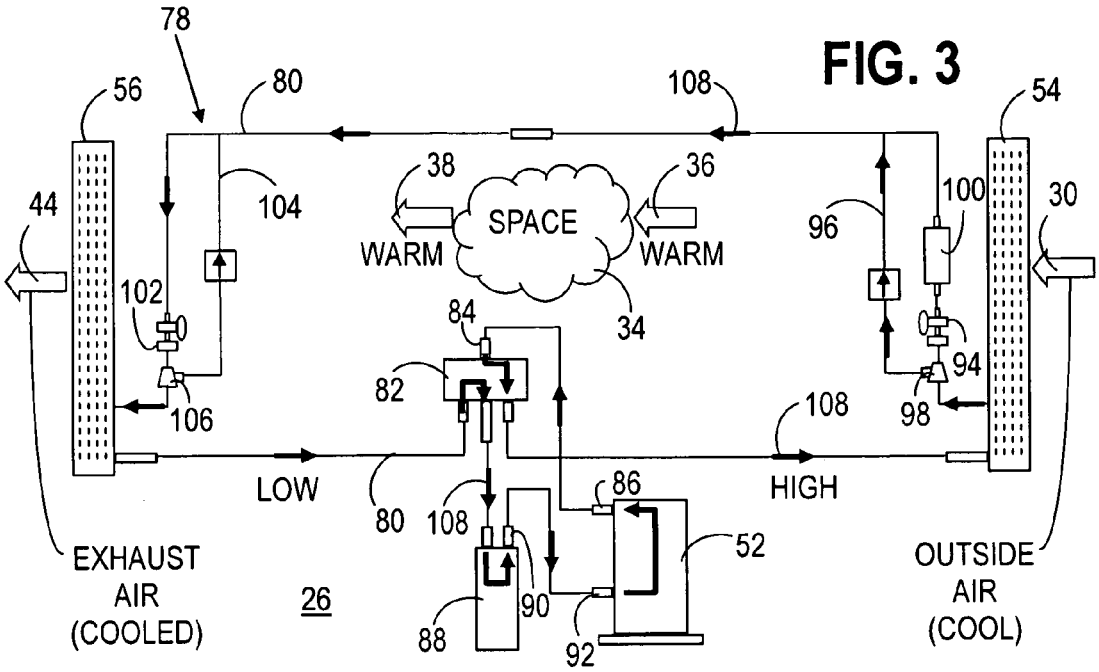
FIG. 3 shows a block diagram of a first conditioning circuit of the system of FIG. 1 in a heating mode.

An embodiment of the invention entails an air conditioning and energy recovery system. Another embodiment of the invention entails a method of controlling the air conditioning and energy recovery system so as to provide effective energy recovery in both the heating and cooling seasons. In particular, the system and methodology enable the recovery of lost energy (btu's) through the condenser cycle by using a refrigerant fluid (e.g., Freon) as the medium of energy recovery instead of conventionally utilized water or air. The incorporation of an energy recovery capability with an air conditioning system enables downsizing of the system relative to prior art heating, ventilation, and air conditioning systems. This downsizing is accomplished through a reduction in peak heating and cooling requirements. Downsizing can result in a system that is half the weight of prior art systems for rooftop mounting. Furthermore, the system and associated methodology can be readily implemented in environments that require up to one hundred percent outside air at high ventilation rates. In addition, the system is operable over a wide range of air conditions, such as from one hundred and twenty-two degrees Fahrenheit to as low as negative ten degrees Fahrenheit.

Referring to FIGS. 1 and 2, FIG. 1 shows a perspective view of an air conditioning and energy recovery system 20 in accordance with an embodiment of the invention, and FIG. 2 shows a plan view of system 20. System 20 is a heat pump, or air-conditioning unit, which is capable of heating and cooling by refrigeration, transferring heat from one (often cooler) medium to another (often warmer) medium. Accordingly, system 20 can provide cooling during warm weather and heating during cool weather. In accordance with the invention, system 20 includes an integral energy recovery capability in order to recover wasted energy, reduce equipment and operating costs, and downsize the equipment relative to prior art systems through a reduction in peak heating and cooling requirements. In addition, system 20 is efficacious for use with commercial facilities and institutions, such as laboratories, kitchens, convention centers, casinos, gyms, factories, hospitals, animal kennels, and the like, that have high outside air requirements and humidity control requirements.

System 20 generally includes a supply section 22, a return section 24, a first conditioning circuit 26, and a second conditioning circuit 28. Supply section 22 is configured to provide a supply air 36 to an interior space 34. In order to do this, supply section 22 recieves air and conditions the air prior to providing the conditioned supply air 36 to interior space 34. To condition the air, supply section 22 uses a first heat exchanger 54 and a third heat exchanger 60 (discussed below), stored within supply section 22, to selectively heat or cool the received air. If necessary, after initial conditioning is done, the humidity level of the air is adjusted through heat exchanger 64 (discussed below).

Return section 24 is configured to accept return air 38 from interior space 34 and release it outside of interior space 34 as exhaust. Prior to releasing return air 38, return section 24 uses a second heat exchanger 56 and a fourth heat exchanger 62 (discussed below), stored within return section 24, to selectively cool or heat return air 38.

In general, outside air 30 is received at an inlet 32 of supply section 22. Outside air 30 is conditioned within supply section 22, and provided to interior space 34 through the appropriate ducting (not shown) as supply air 36. This conditioning includes increasing or decreasing the temperature of the air as well as altering the humidity level as needed. In addition, return section 24 receives return air 38 from interior space 34. Return air 38 is conditioned in return section 24 to selectively recover heating energy or cooling energy (discussed below) prior to its discharge from an outlet 42 of return section 24 outside of interior space 34 as exhaust air 44. First and second conditioning circuits 26 and 28 carry heat transporting fluids between supply section 22 and return section 24 to condition the air in supply section 22 and recover energy from return section 24. First and second conditioning circuits 26 and 28 are discussed in further detail in connection with FIGS. 3-6 below.

System 20 is located in a housing 46, or cabinet, that may be mounted on top of, for example, the roof of a business establishment. Housing 46 may include doors 48 for access to the components of system 20. Access through doors 48 enables ready removal, replacement, and/or servicing of fans, motors, and other components of system 20. A controller 50 may be located in part or in its entirety internal to housing 46. Alternatively, controller 50 may be located remote from housing 46 for ready access by a user. Controller 50 may control the components of system 20 via a wired or wireless connection.

First conditioning circuit 26 includes a first compressor 52, first heat exchanger 54 residing in supply section 22, and a second heat exchanger 56 residing in return section 24. Likewise, second conditioning circuit 28 includes a second compressor 58, a third heat exchanger 60 residing in supply section 22, and a fourth heat exchanger 62 residing in return section 24. A fifth heat exchanger 64 additionally resides in supply section 22. Fifth heat exchanger 64 is a component of a third conditioning circuit 66 in selective fluid communication with second conditioning circuit 28 (discussed below). Supply section 22 further includes a filter 68, a supply fan 70, and an optional furnace 72. Return section 24 further includes a filter 74 and a return fan 76. In one embodiment, first 54, second 56, third 60, fourth 62 and fifth 64 heat exchangers are coils.

When system 20 is activated, supply fan 70 draws outside air 30 into supply section 22 through filter 68, which may be a 30/30 filter, for filtering contaminants from outside air 30. Outside air 30 passes through furnace 72 where air 30 may be at least partially warmed during periods of extreme cold. Outside air 30 passes over first heat exchanger 54 where it may be selectively heated or cooled in accordance with a particular heating or cooling mode control stage. Likewise, outside air 30 passes over third heat exchanger 60 where it may be selectively heated or cooled in accordance with a particular heating or cooling mode control stage. Outside air 30 then passes by fifth heat exchanger 64 of third conditioning circuit 66 where it may be heated to dry it out, i.e. dehumidify, outside air 30 prior to the provision of the conditioned supply air 36 to interior space 34.

Additionally, when system 20 is activated, return fan 76 draws return air 38 into return section 24 through filter 74, which may be a 30/30 filter for filtering contaminants from return air 38. Return air 38 passes over second heat exchanger 56 where some of the energy used to heat or cool the return air 38 may be recovered in accordance with a particular heating or cooling mode control stage via a refrigerant loop. Return air 38 then passes over fourth heat exchanger 62 where additional heating or cooling energy of return air 38 may be recovered in accordance with a particular heating or cooling mode control stage prior to its discharge from outlet 42 as exhaust air 44.

The heating and cooling modes for first and second conditioning circuits 26 and 28 are discussed in connection with FIGS. 3-6. The dehumidification mode for third conditioning circuit 66 is discussed in connection with FIG. 7. In addition, a system control process and the various operational stages for each of the heating, cooling, and dehumidification modes are discussed in connection with FIGS. 8-11.

FIG. 3 shows a block diagram of first conditioning circuit 26, also referred to as circuit A, of system 20 (FIG. 1) in a heating mode 78. First conditioning circuit 26 includes compressor 52, first heat exchanger 54, and second heat exchanger 56 in fluid communication via a fluid loop 80. In one embodiment, compressor 52 may carry a larger load than compressor 58 (FIG. 2) of second conditioning circuit 28. For example, compressor 52 may be a thirteen ton compressor, whereas compressor 58 may be a nine ton compressor. A direction of fluid (i.e., refrigerant) through fluid loop 80 is governed by a reversing valve 82 positioned in fluid loop 80 having an input 84 in fluid communication with an outlet 86 of compressor 52. Per convention, a receiver 88 may be positioned in fluid loop 80 having an outlet 90 in fluid communication with an inlet 92 of compressor 52.

A metering device 94, which may be in the form of a restrictor or an expansion valve, and a bypass line 96 are located in fluid loop 80 and are associated with first heat exchanger 54. Selection of a fluid route through metering device 94 or bypass line 96 is accomplished by actuation of a bypass valve 98. A fluid filter 100 may be in fluid communication with metering device 94. Likewise, a metering device 102 and a bypass line 104 are located in fluid loop 80 and are associated with second heat exchanger 56. Selection of a fluid route through metering device 102 or bypass line 104 is accomplished by actuation of a bypass valve 106.

In heating mode 78, reversing valve 82 is energized to enable a flow of refrigerant 108 from compressor 52 toward first heat exchanger 54 via fluid loop 80. That is, relatively high pressure refrigerant 108 is discharged in a gaseous form from compressor 52 via fluid loop 80 to first heat exchanger 54. As cool outside air 30 passes through first heat exchanger 54, outside air 30 removes heat from (i.e., cools) refrigerant 108 so that outside air 30 is warmed. The warmed outside air 30 subsequently passes through additional components of supply section 22 (discussed above) and is delivered as warm supply air 36 to space 34. The cooled refrigerant 108 continues through fluid loop 80 via bypass line 96 and passes through metering device 102.

Metering device 102 controls the pressure and flow of refrigerant 108 into second heat exchanger 56, residing in return section 24. As the warmed return air 38 passes through return section 24, the cooled refrigerant 108 in second heat exchanger 56 removes heat from (i.e., cools) return air 38 so that exhaust air 44 is cooled. Relatively low pressure refrigerant 108 returns to compressor 52 from second heat exchanger 56 via fluid loop 80 and receiver 88 where the refrigeration cycle is continued. Thus, refrigerant 108 is at least partially warmed by the heat energy in return air 38 that would normally have been wasted. This recovered heat energy enables the high pressure refrigerant 108 entering first heat exchanger 54 to be warmer relative to outside air 30 than it would have been without the exchange in heat exchanger 56 and to impart a greater transfer of heat to outside air 30.

Figure 4:
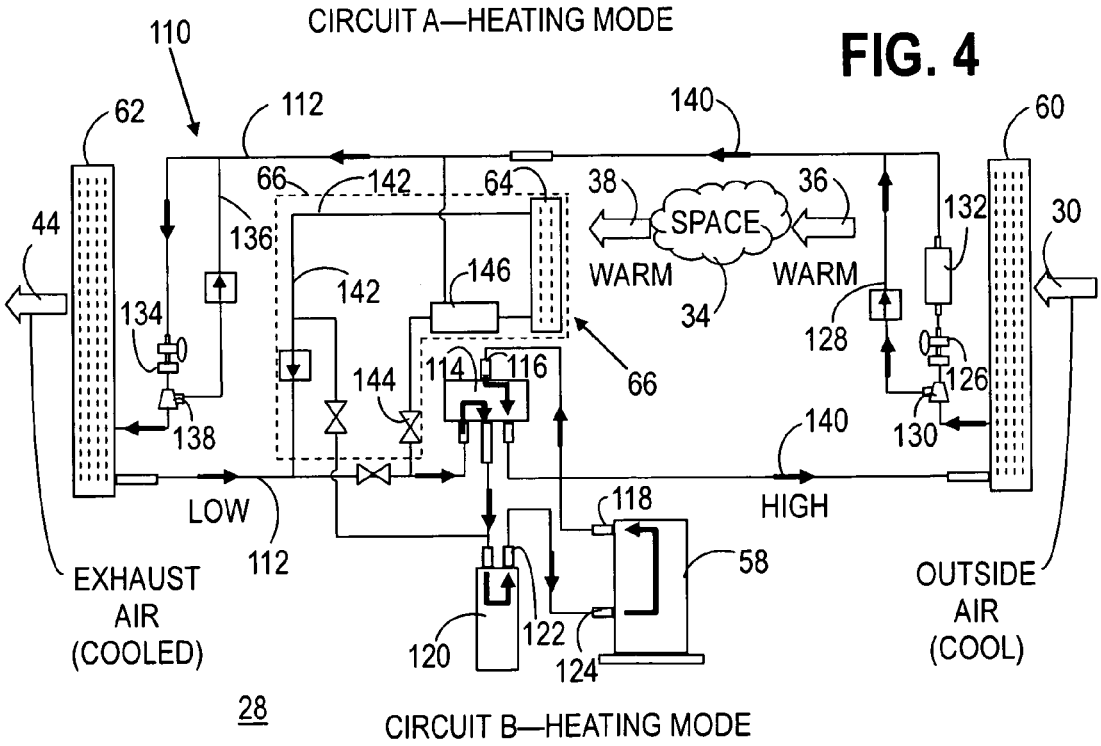
FIG. 4 shows a block diagram of a second conditioning circuit of the system of FIG. 1 in a heating mode.

FIG. 4 shows a block diagram of second conditioning circuit 28, also referred to as Circuit B, of system 20 (FIG. 1) in a heating mode 110. Second conditioning circuit 28 includes second compressor 58, third heat exchanger 60, and fourth heat exchanger 62 in fluid communication via a fluid loop 112. A direction of fluid 140 (i.e., refrigerant) through fluid loop 112 is governed by a reversing valve 114 positioned in fluid loop 112 having an input 116 in fluid communication with an outlet 118 of second compressor 58. A receiver 120 may be positioned in fluid loop 112 having an outlet 122 in fluid communication with an inlet 124 of compressor 58.

A metering device 126, which may be in the form of a restrictor or an expansion valve, and a bypass line 128 are located in fluid loop 112 and are associated with third heat exchanger 60. Selection of a fluid route through metering device 126 or bypass line 128 is accomplished by actuation of a bypass valve 130. A fluid filter 132 may be in fluid communication with metering device 126. Likewise, a metering device 134 and a bypass line 136 are located in fluid loop 112 and are associated with fourth heat exchanger 62. Selection of a fluid route through metering device 134 or bypass line 136 is accomplished by actuation of a bypass valve 138.

In heating mode 110, reversing valve 114 is energized to enable a flow of refrigerant 140 from compressor 58 toward third heat exchanger 60 via fluid loop 112. That is, relatively high pressure refrigerant 140 is discharged in a gaseous form from compressor 58 via fluid loop 112 to third heat exchanger 60. As cooler outside air 30 passes through heat exchanger 60, outside air 30 removes heat from (i.e., cools) refrigerant 140 so that outside air 30 is warmed. The warmed outside air 30 subsequently passes through additional components of supply section 22 (discussed above) and is delivered as warm supply air 36 to space 34. The cooled refrigerant 140 continues through fluid loop 112 via bypass line 128 and passes through metering device 134.

Metering device 134 controls the pressure and flow of refrigerant 140 into fourth heat exchanger 62, residing in return section 24 (FIG. 2). As the warmed return air 38 passes through return section 24, the cooled refrigerant 140 in fourth heat exchanger 62 removes heat from (i.e., cools) return air 38 so that exhaust air 44 is cooled. Relatively low pressure refrigerant 140 returns to compressor 58 from fourth heat exchanger 62 via fluid loop 112 and receiver 120 where the refrigeration cycle is continued. Thus, refrigerant 140 is at least partially warmed by the heat energy in return air 38 that would normally have been wasted. This recovered heat energy enables the high pressure refrigerant 140 entering second heat exchanger 60 to be warm relative to outside air 30 so as to warm outside air 30. The activation of first conditioning circuit 26 (FIG. 3) in heating mode 78 (FIG. 3) and/or second conditioning circuit 28 in heating mode 110 will be discussed in connection with FIG. 9.

Third conditioning circuit 66 is also in communication with second conditioning circuit 28 via a fluid loop 142. Third conditioning circuit 66 includes a reheat valve 144, a compressor 146, and fifth heat exchanger 64 in fluid communication via fluid loop 142. Reheat valve 144 may be selectively enabled to allow a flow of fluid though fluid loop 142 into compressor 146 and fifth heat exchanger 64 and return that fluid to fluid loop 112 of second conditioning circuit 28 when the dehumidification of outside air 30 is required. A dehumidification mode is discussed in connection with FIGS. 7 and 11 and is typically executed in connection with a cooling mode for either of first and second conditioning circuits 22 and 24.

Figure 5:
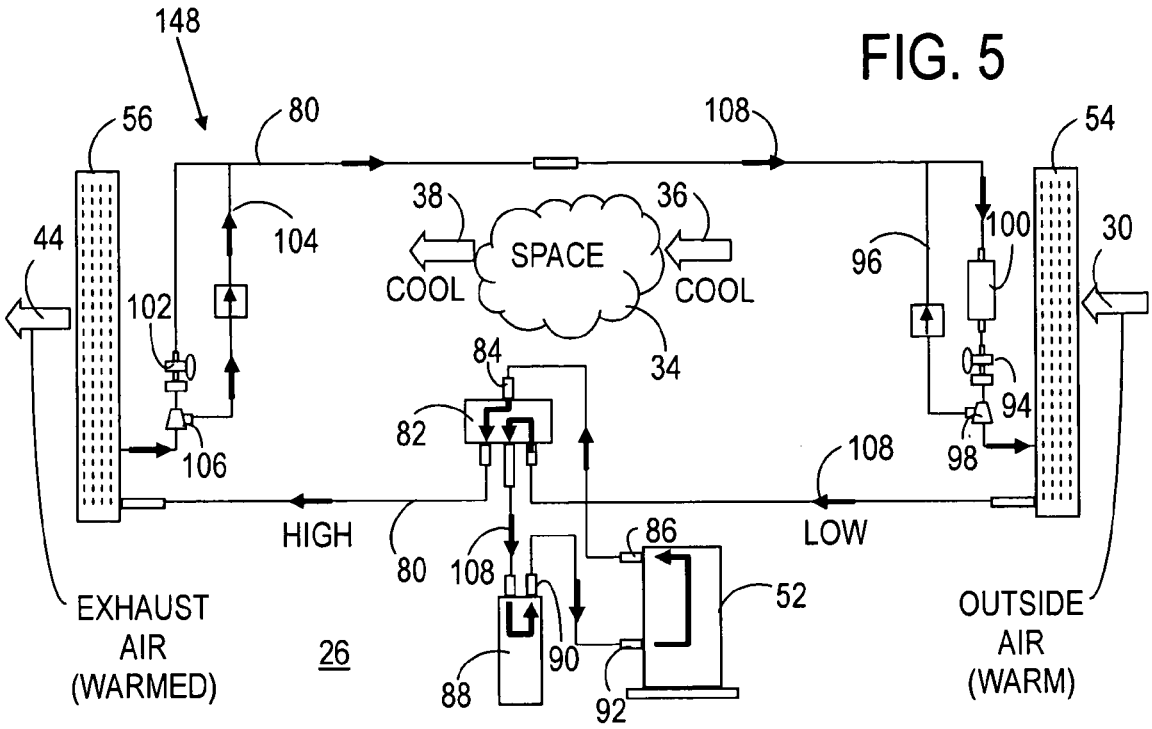
FIG. 5 shows a block diagram of the first conditioning circuit in a cooling mode.

FIG. 5 shows a block diagram of first conditioning circuit 26 in a cooling mode 148. In cooling mode 148, reversing valve 82 is disabled to enable a default flow of refrigerant 108 from compressor 52 away from first heat exchanger 54 and toward second heat exchanger 56 via fluid loop 80. That is, relatively high pressure refrigerant 108 is discharged in a gaseous form from compressor 52 via fluid loop 80 to second heat exchanger 56.

At second heat exchanger 56, refrigerant 108 is condensed and cooled by the action of the cooler return air 38 flowing through second heat exchanger 56. That is, refrigerant cools in response to return air 38 to recover energy previously expended in cooling interior space 34. Refrigerant flows via bypass line 104 and fluid loop 80 to metering device 94. Metering device 94 controls the pressure and flow of refrigerant 108 into first heat exchanger 54. As warm outside air 30 passes through first heat exchanger 54, refrigerant 108 in first heat exchanger 54 removes heat (i.e., cools) outside air 30. The cooled outside air 30 subsequently passes through additional components of supply section 22 (discussed above) and is delivered as cool supply air 36 to space 34. Warmed refrigerant 108 exits first heat exchanger 54 and is returned via fluid loop 80 to compressor 52 where the refrigeration cycle is continued.

Figure 6:
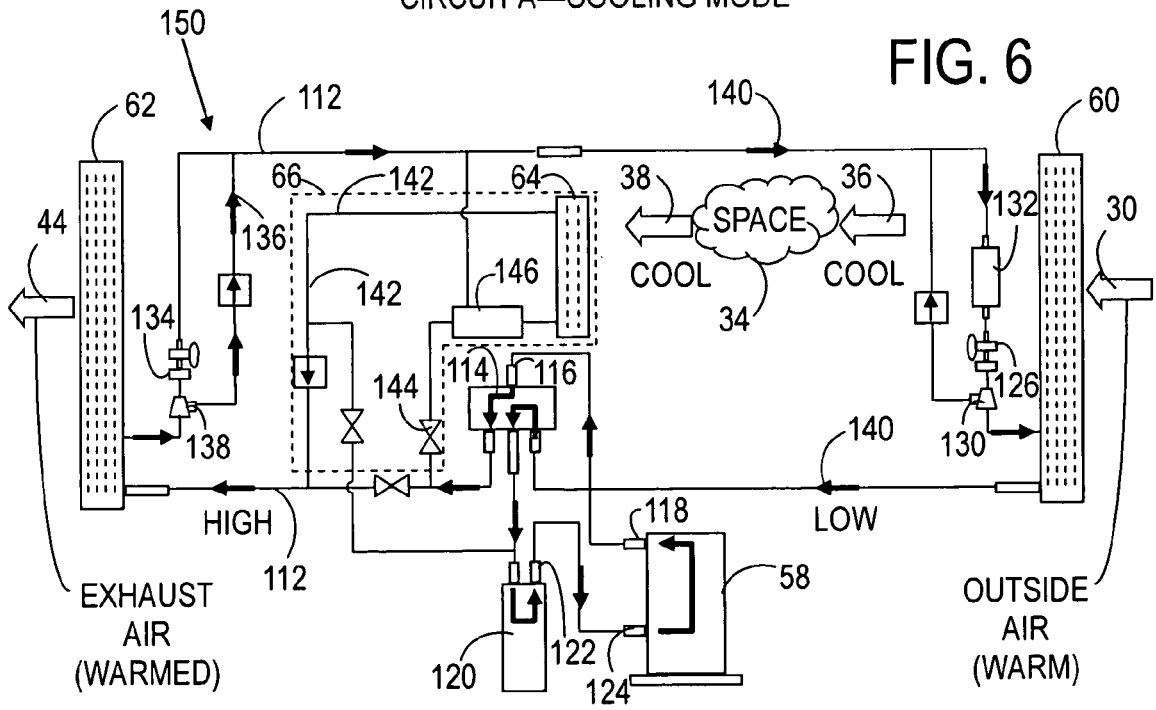
FIG. 6 shows a block diagram of the second conditioning circuit in a cooling mode.

FIG. 6 shows a block diagram of second conditioning circuit 28 in a cooling mode 150. In cooling mode 150, reversing valve 114 is disabled to enable a default flow of refrigerant 140 from compressor 58 away from third heat exchanger 60 and toward fourth heat exchanger 62 via fluid loop 112. That is, relatively high pressure refrigerant 140 is discharged in a gaseous form from compressor 58 via fluid loop to fourth heat exchanger 62.

At fourth heat exchanger 62, refrigerant 140 is condensed and cooled by the action of the cooler return air 38, flowing through fourth heat exchanger 62. That is, refrigerant cools in response to return air 38 to recover energy previously expended in cooling interior space 34. Refrigerant 140 flows via bypass line 136 and fluid loop 112 to metering device 126. Metering device 126 controls the pressure and flow of refrigerant 140 into third heat exchanger 60. As warm outside air 30 passes through third heat exchanger 60, refrigerant 140 in third heat exchanger 60 removes heat (i.e., cools) outside air 30. The cooled outside air 30 subsequently passes through additional components of supply section 22 (discussed above) and is delivered as cool supply air 36 to space 34. Warmed refrigerant 140 exits third heat exchanger 60 and is returned via fluid loop 112 to compressor 58 where the refrigeration cycle is continued. The activation of first conditioning circuit 26 (FIG. 5) in cooling mode 148 (FIG. 5) and/or second conditioning circuit 28 in cool mode 150 will be discussed in connection with FIG. 10.

Figure 7:
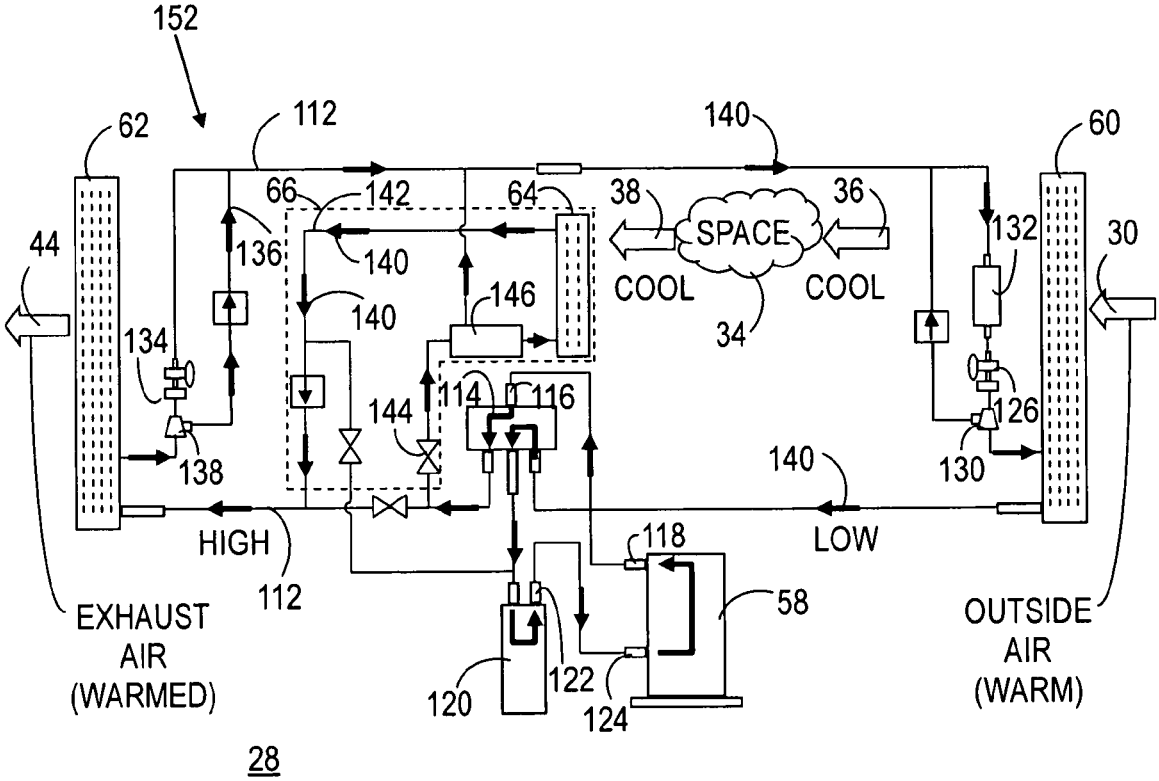
FIG. 7 shows a block diagram of the second conditioning circuit with a third conditioning circuit in a dehumidification mode.

FIG. 7 shows a block diagram of second conditioning circuit 28 with third conditioning circuit 66 in a dehumidification mode 152. Under certain conditions, and particularly during the hot season, the moisture content of outside air 30 may be undesirably high. That is, outside air 30 may be undesirably humid, or saturated with moisture. Accordingly, it may be desirable to dehumidify supply air 36 prior to its provision to interior space 34.

When outside air 30 is to be dehumidified in connection with either of cooling modes 148 and 150, reheat valve 144 is enabled to allow a flow of warm, high pressure refrigerant 140 into fluid loop 142. Refrigerant passes through compressor 146 and into fifth heat exchanger 64 residing in supply section 22 (FIG. 2). Outside air 30 passing through fifth heat exchanger 64 is heated by a few degrees, for example, eight degrees, to dry (i.e., dehumidify) outside air prior to its provision into space 34 and supply air 36. Cooled refrigerant 140 exiting fifth heat exchanger 64 is returned via fluid loop 142 to fluid loop 112.

Figure 8:
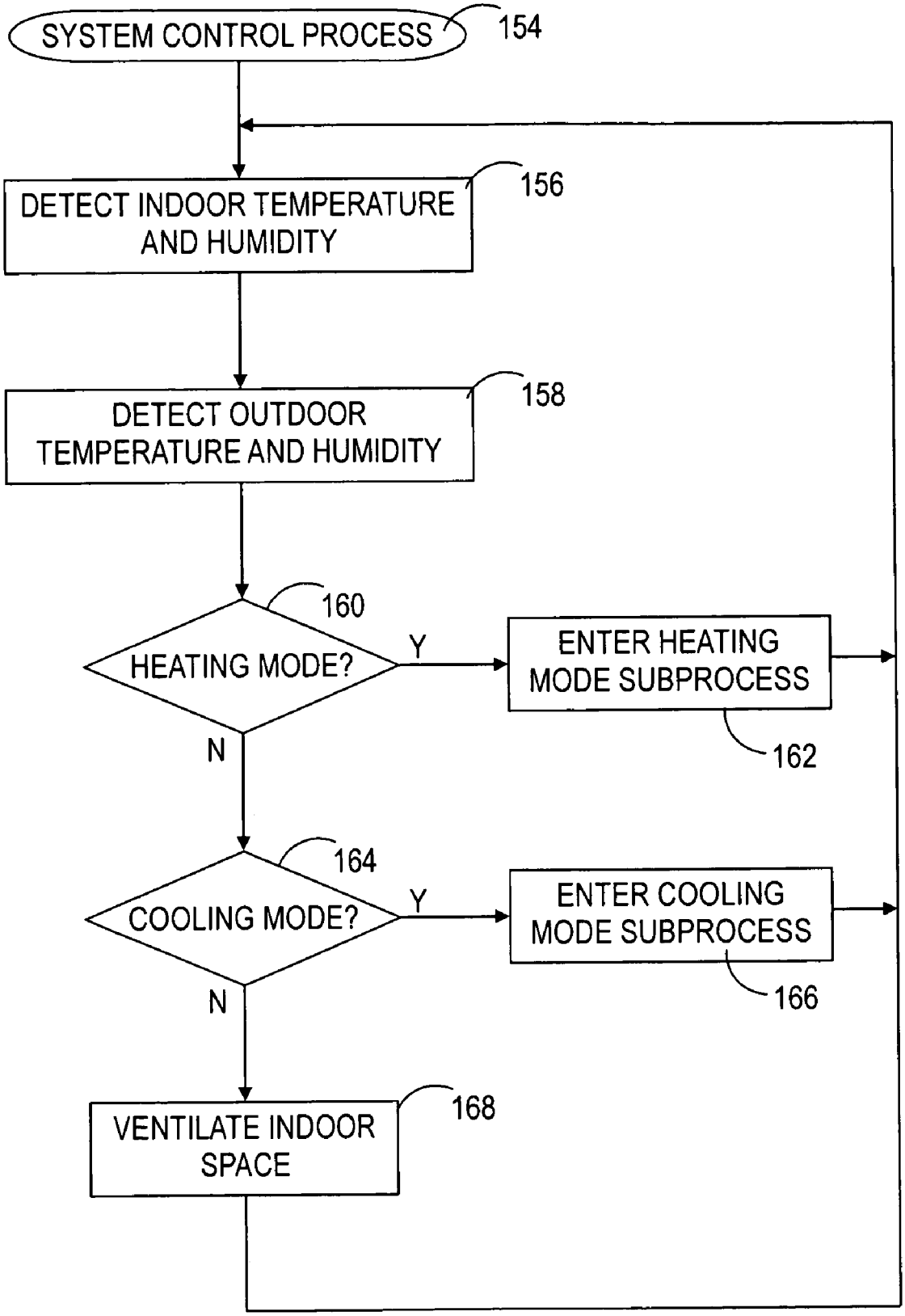
FIG. 8 shows a flowchart of a system control process in accordance with another embodiment of the invention.

FIG. 8 shows a flowchart of a system control process 154 in accordance with another embodiment of the invention. System control process 154 may be executed by controller 50 (FIG. 2) to determine whether air conditioning and energy recovery system 20 should operate in a heating mode or a cooling mode with or without a dehumidification mode.

System control process begins with a task 156. At task 156, temperature and humidity of interior space 34 (FIG. 2) are detected. Next, at a task 158, temperature and humidity of outside air 30 are detected.

In response to tasks 156 and 158, controller 50 determines whether system 20 should be placed in a heating mode, for example, when the temperature (either sensible or wet bulb) of outside air 30 (FIG. 1) drops below a predetermined heating threshold. When a determination is made that system 20 should go into a heating mode, control process 154 proceeds to a task 162. At task 162, system 20 enters a heating mode subprocess, discussed in connection with FIG. 9. However, when a determination is made that system 20 should not be placed in a heating mode, control process 154 proceeds to a query task 164.

At query task 164, controller 50 determines whether system 20 should be placed in a cooling mode, for example, when outside temperature (either sensible or wet bulb) rises above a predetermined cooling threshold. When a determination is made that system 20 should go into a cooling mode, control process 154 proceeds to a task 166. At task 166, system 20 enters a cooling mode subprocess, discussed in connection with FIG. 10. At task 166, a determination may additionally be made whether to perform a dehumidification mode subprocess in conjunction with the cooling mode subprocess. This determination may be made when, for example, the humidity of outside air 30 (FIG. 1) exceeds a predetermined humidity threshold. When outside air 30 is to be dehumidified, a dehumidification mode subprocess, discussed in connection with FIG. 11, will be performed in conjunction with the cooling mode subprocess.

At query task 164, when a determination is made that system 20 should not be placed in a cooling mode, control process 154 proceeds to a task 168. At task 168, the temperature and humidity of outside air 30 are such that it does not require heating, cooling, or dehumidification. As such, system 20 can go into a free cooling state with just ventilation being provided through the activation of supply fan 70 (FIG. 2) and return fan 76 (FIG. 2).

Following any of tasks 162, 166, and 168, process control loops back to task 156 to continue monitoring indoor and outdoor temperatures and to control heating, cooling, and dehumidification as required.

Figure 9:
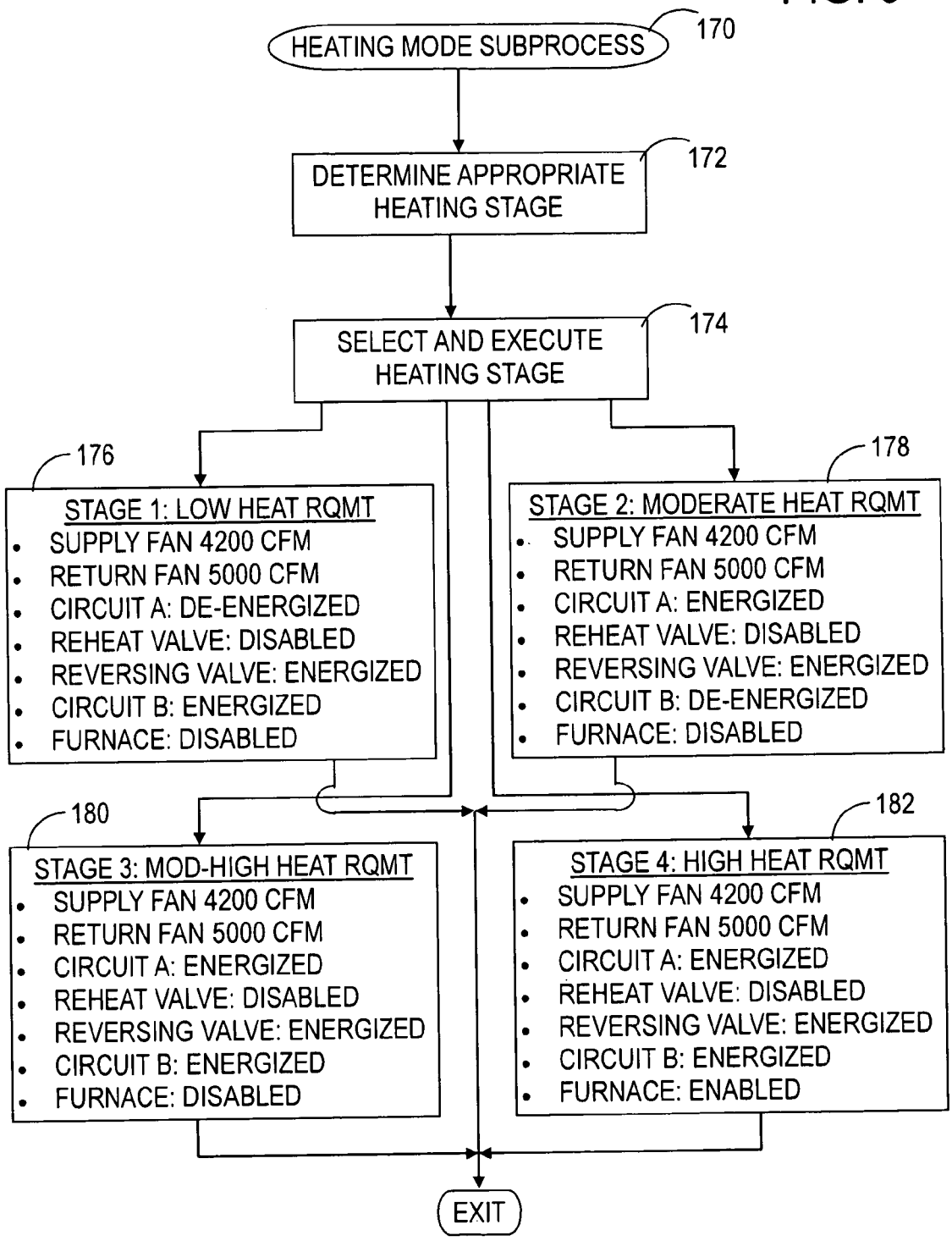
FIG. 9 shows a flowchart of a heating mode subprocess in accordance with the system control process.

FIG. 9 shows a flowchart of a heating mode subprocess 170 in accordance with system control process 154 (FIG. 8). Heating mode subprocess 170 is performed when a determination is made at query task 160 that system 20 is to enter a heating mode.

Heating mode subprocess 170 begins with a task 172. At task 172, controller 50 (FIG. 2) determines an appropriate heating stage to perform. Controller 50 may be a proportional-integral-derivative (PID) controller. A PID controller is a control loop feedback mechanism typically used in industrial control systems. A PID controller attempts to correct the error between a measured process variable (e.g., measured indoor air temperature and humidity) and a desired setpoint (e.g., desired indoor air temperature and humidity) by calculating and then outputting a corrective action that can adjust the heating and/or cooling accordingly.

A task 174 is performed in cooperation with task 172. At task 176, controller 50 selects and initiates execution of a heating mode stage.

In an exemplary configuration, controller 50 selects a desired heating mode stage from one of four operational stages—Stage 1: low heat requirement 176, Stage 2: moderate heat requirement 178, Stage 3: moderate-to-high heat requirement 180, and Stage 4: high heat requirement 182. In this example, each progressively higher numerical "stage" represents conditions in which the temperature of outdoor air 30 is progressively lower (i.e., colder), thus requiring progressively greater work from first and/or second conditioning circuits 26 and 28 to achieve and maintain a desired set point in interior space 34 (FIG. 1).

Following the initiation of any of stages 176, 178, 180, and 182, at task 174 the desired "stage" of heating will continue in response to the temperature of space 34, as well as the temperature of outdoor air 30. When heating is no longer required, heating mode subprocess 170 exits. Each of stages 176, 178, 180, and 182 is discussed briefly below.

At Stage 1: low heat requirement 176, supply and return fans 70 and 76, respectively, (FIG. 2) are set to a desired fan speed. For example, supply fan 70 may be set to 4200 cubic-feet-per-minute (cfm) and return fan 76 may be set to 5000 cfm. In addition, first conditioning circuit, circuit A, 26 (FIG. 3) is de-energized, reheat valve 144 (FIG. 4) is disabled, and furnace 72 (FIG. 2) is off. In addition, second conditioning circuit, circuit B, 28 (FIG. 4) is energized and reversing valve 114 (FIG. 4) for second conditioning circuit B 28 is energized. Thus, execution of Stage 1: low heat requirement 176 results in only heating mode 110 (FIG. 4).

At Stage 2: moderate heat requirement 178, supply and return fans 70 and 76, respectively, are set to a desired fan speed. For example, supply fan 70 may be set to 4200 cubic-feet-per-minute (cfm) and return fan 76 may be set to 5000 cfm. In addition, first conditioning circuit, circuit B, 28 (FIG. 4) is de-energized, reheat valve 144 (FIG. 4) is disabled, and furnace 72 is off. Now, however, first conditioning circuit, circuit A, 26 is energized and reversing valve 82 (FIG. 3) for first conditioning circuit A 26 is energized. Consequently, execution of Stage 2: moderate heat requirement 178 results in only heating mode 78 (FIG. 3).

At Stage 3: moderate-to-high heat requirement 180, supply and return fans 70 and 76, respectively, are set to a desired fan speed. For example, supply fan 70 may be set to 4200 cubic-feet-per-minute (cfm) and return fan 76 may be set to 5000 cfm. In addition, first conditioning circuit, circuit A, 26 (FIG. 3) is energized and reversing valve 82 (FIG. 3) for first conditioning circuit A 26 is energized. In addition, second conditioning circuit, circuit B, 28 is energized and reversing valve 114 (FIG. 4) for second conditioning circuit B is energized. However, reheat valve 144 (FIG. 4) is disabled and furnace 72 (FIG. 2) is off. Consequently, execution of Stage 3: moderate-to-high heat requirement 180 results in both heating mode 78 (FIG. 3) and heating mode 110 (FIG. 4).

At Stage 4: high heat requirement 182, supply and return fans 70 and 76, respectively, are set to a desired fan speed. For example, supply fan 70 may be set to 4200 cubic-feet-per-minute (cfm) and return fan 76 may be set to 5000 cfm. In addition, first conditioning circuit, circuit A, 26 (FIG. 3) is energized and reversing valve 82 (FIG. 3) for first conditioning circuit A 26 is energized. In addition, second conditioning circuit, circuit B, 28 is energized and reversing valve 114 (FIG. 4) for second conditioning circuit B is energized. Reheat valve 144 (FIG. 4) is disabled, but in this instance, furnace 72 is enabled. Consequently, execution of Stage 4: high heat requirement 182 results in both heating mode 78 (FIG. 3) and heating mode 110 (FIG. 4), as well as supplemental heating from furnace 72.

Figure 10:
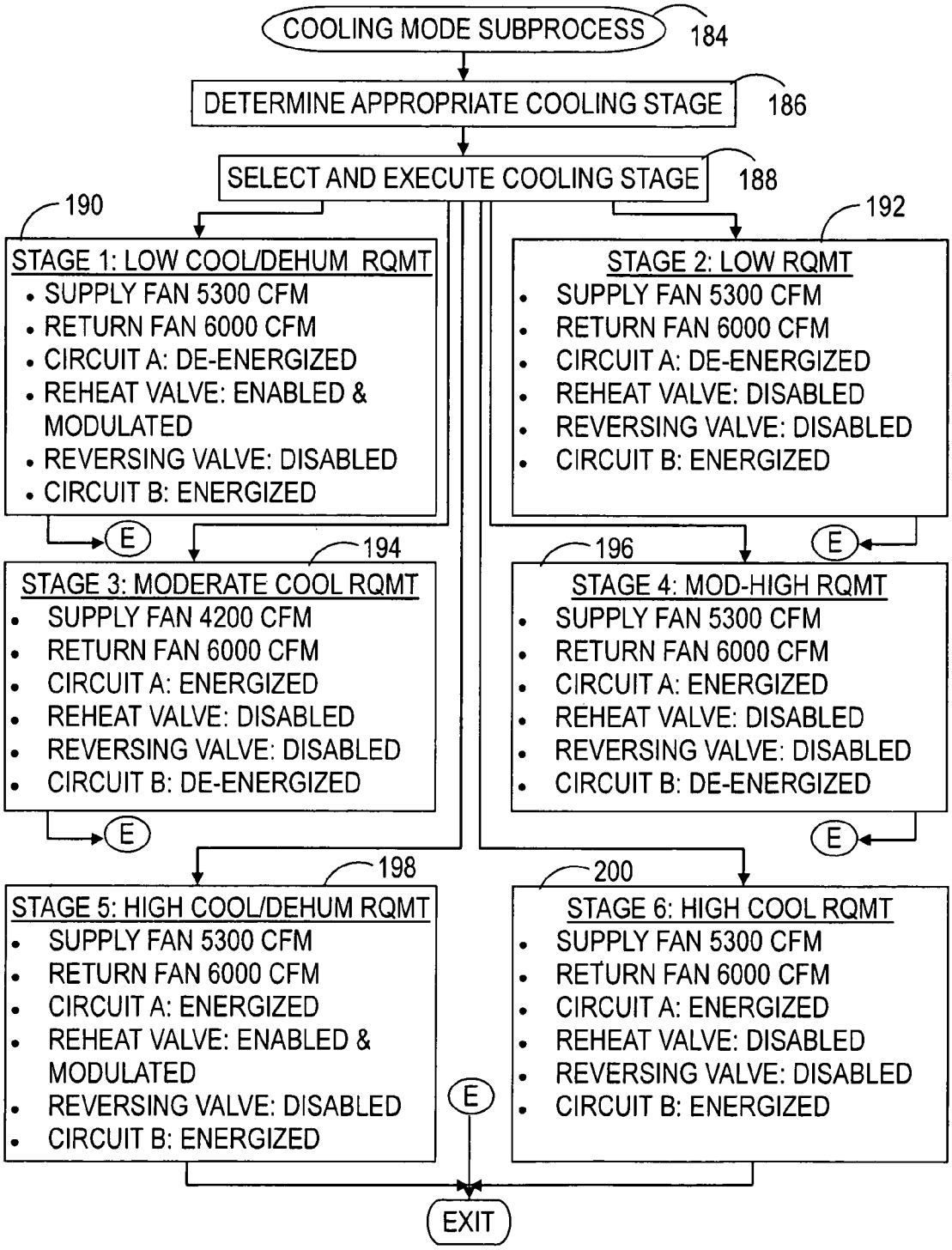
FIG. 10 shows a flowchart of a cooling mode subprocess in accordance with the system control process.

FIG. 10 shows a flowchart of a cooling mode subprocess 184 in accordance with system control process 154 (FIG. 8). Cooling mode subprocess 184 is performed when a determination is made at query task 164 (FIG. 8) that system 20 is to enter a cooling mode.

Cooling mode subprocess 184 begins with a task 186. At task 186, controller 50 (FIG. 2) determines an appropriate cooling mode stage to perform, as discussed in connection with task 172 (FIG. 9) of heating mode subprocess 170 (FIG. 9). A task 188 is performed in cooperation with task 186. At task 188, controller 50 selects and initiates execution of a cooling mode stage.

In an exemplary configuration, controller 50 selects a desired cooling mode stage from one of six operational stages—Stage 1: low cool/dehumidification requirement 190, Stage 2: low cool no dehumidification requirement 192, Stage 3: moderate cool no dehumidification requirement 194, Stage 4: moderate-to-high cool no dehumidification requirement 196, Stage 5: high cool/dehumidification requirement 198, and Stage 6: high cool no dehumidification requirement 200. In this example, each progressively higher numerical "stage" represents conditions in which the temperature of outdoor air 30 is progressively higher (i.e., colder) and/or more humid, thus requiring progressively greater work from first and/or second conditioning circuits 26 and 28 to achieve and maintain a desired set point in interior space 34 (FIG. 1).

Following the initiation of any of stages 190, 192, 194, 196, 198, and 200, at task 188 the desired "stage" of cooling will continue in response to the temperature of space 34, as well as the temperature of outdoor air 30. When cooling is no longer required, cooling mode subprocess 184 exits. Each of stages 190, 192, 194, 196, 198, and 200 is discussed briefly below. Although not expressly stated below, it should be understood that since the following stages 190, 192, 194, 196, 198, and 200 are related to cooling, furnace 72 (FIG. 2) will always be off.

Figure 11:
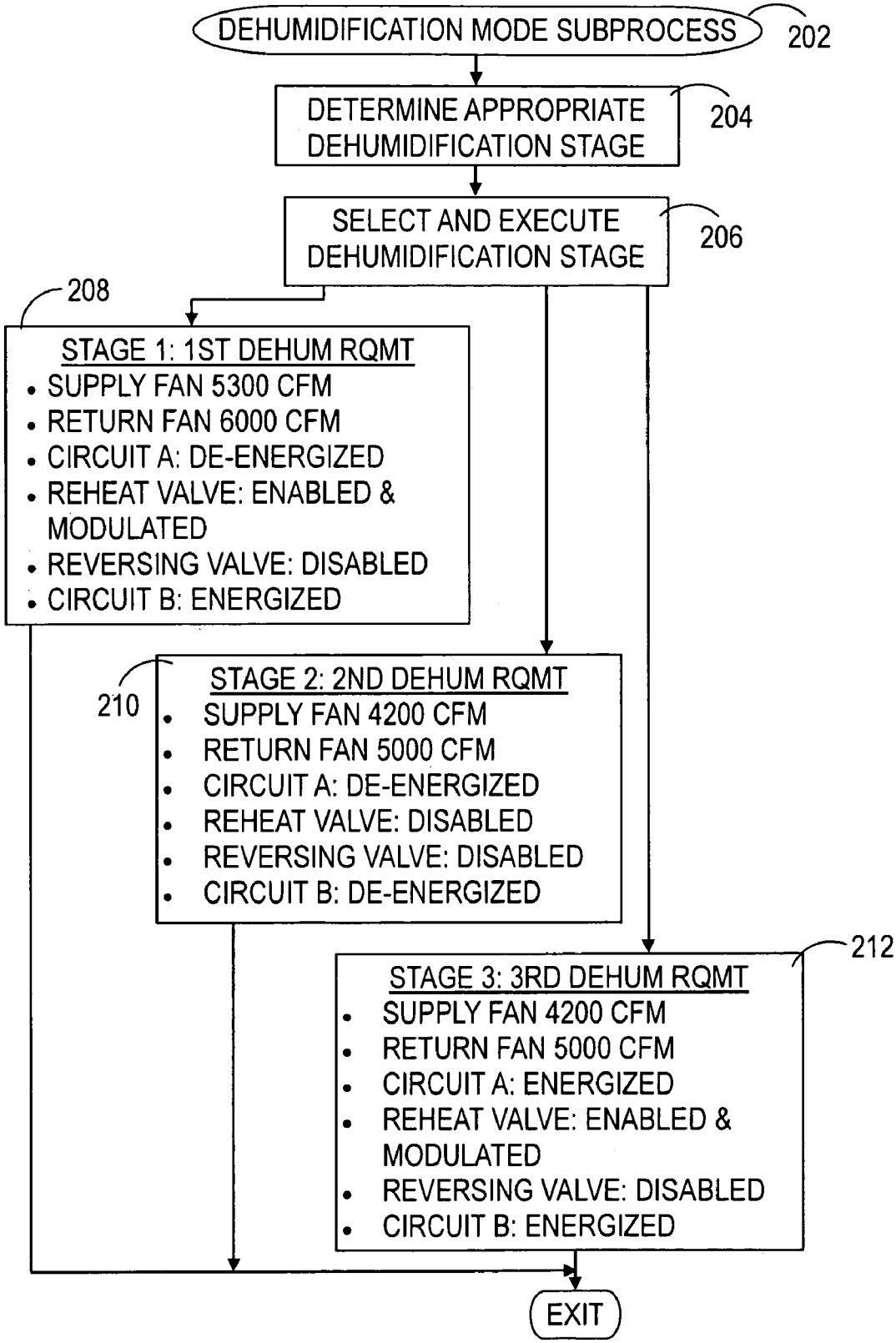
FIG. 11 shows a flowchart of a dehumidification mode subprocess in accordance with the system control process.

At Stage 1: low cool/dehumidification requirement 190, supply and return fans 70 and 76, respectively, (FIG. 2) are set to a desired fan speed. For example, supply fan 70 may be set to 5300 cubic-feet-per-minute (cfm) and return fan 76 may be set to 6000 cfm. In addition, first conditioning circuit, circuit A, 26 (FIG. 3) is de-energized. In this instance, reheat valve 144 (FIG. 4) is enabled and modulated by a dehumidification subprocess 202 (FIG. 11). In addition, second conditioning circuit, circuit B, 28 (FIG. 4) is energized and reversing valve 114 (FIG. 4) for second conditioning circuit B 28 is disabled. Thus, execution of Stage 1: low cool/dehumidification requirement 190 results in cooling mode 150 (FIG. 6) with an accompanying dehumidification mode 152 (FIG. 7).

At Stage 2: low cool no dehumidification requirement 192, supply and return fans 70 and 76, respectively, (FIG. 2) are set to a desired fan speed. For example, supply fan 70 may be set to 5300 cubic-feet-per-minute (cfm) and return fan 76 may be set to 6000 cfm. In addition, first conditioning circuit, circuit A, 26 (FIG. 3) is de-energized. Since dehumidification is not required, reheat valve 144 (FIG. 4) is disabled. In addition, second conditioning circuit, circuit B, 28 (FIG. 4) is energized and reversing valve 114 (FIG. 4) for second conditioning circuit B 28 is disabled. Thus, execution of Stage 2: low cool no dehumidification requirement 192 results in only cooling mode 150 (FIG. 6).

At Stage 3: moderate cool no dehumidification requirement 194, supply and return fans 70 and 76, respectively, (FIG. 2) are set to a desired fan speed. For example, supply fan 70 may be set to 4200 cubic-feet-per-minute (cfm) and return fan 76 may be set to 6000 cfm. In addition, second conditioning circuit, circuit B, 28 (FIG. 4) is de-energized and reheat valve 144 (FIG. 4) is disabled. However, first conditioning circuit, circuit A, 26 (FIG. 3) is energized and reversing valve 82 (FIG. 3) for first conditioning circuit A 26 is disabled. Thus, execution of Stage 3: moderate cool no dehumidification requirement 194 results in only cooling mode 148 (FIG. 5).

At Stage 4: moderate-to-high cool no dehumidification requirement 196, supply and return fans 70 and 76, respectively, (FIG. 2) are set to a desired fan speed. For example, supply fan 70 may be set to 5300 cubic-feet-per-minute (cfm) and return fan 76 may be set to 6000 cfm. In addition, second conditioning circuit, circuit B, 28 (FIG. 4) is de-energized and reheat valve 144 (FIG. 4) is disabled. However, first conditioning circuit, circuit A, 26 (FIG. 3) is energized and reversing valve 82 (FIG. 3) for first conditioning circuit A 26 is disabled. Thus, execution of Stage 3: moderate cool no dehumidification requirement 196 results in only cooling mode 148 (FIG. 5), but at a greater supply fan 70 speed then that of Stage 3 194.

At Stage 5: high cool/dehumidification requirement 198, supply and return fans 70 and 76, respectively, (FIG. 2) are set to a desired fan speed. For example, supply fan 70 may be set to 5300 cubic-feet-per-minute (cfm) and return fan 76 may be set to 6000 cfm. In this instance, reheat valve 144 (FIG. 4) is enabled and modulated by dehumidification subprocess 202 (FIG. 11). In addition, both first conditioning circuit, circuit A, 26 (FIG. 3) and second conditioning circuit, circuit B, 28 (FIG. 4) are energized and their corresponding reversing valves 82 and 114 are disabled. Thus, execution of Stage 5: high cool/dehumidification requirement 198 results in both cooling mode 148 (FIG. 5) and cooling mode 150 (FIG. 6), as well as dehumidification mode 152 (FIG. 7).

At Stage 6: high cool no dehumidification requirement 200, supply and return fans 70 and 76, respectively, (FIG. 2) are set to a desired fan speed. For example, supply fan 70 may be set to 5300 cubic-feet-per-minute (cfm) and return fan 76 may be set to 6000 cfm. In this instance, reheat valve 144 (FIG. 4) disabled. In addition, both first conditioning circuit, circuit A, 26 (FIG. 3) and second conditioning circuit, circuit B, 28 (FIG. 4) are energized and their corresponding reversing valves 82 and 114 are disabled. Thus, execution of Stage 5: high cool no dehumidification requirement 200 results in both cooling mode 148 (FIG. 5) and cooling mode 150 (FIG. 6).

FIG. 11 shows a flowchart of a dehumidification mode subprocess 202 in accordance with system control process 154 (FIG. 8).

Dehumidification mode subprocess 202 begins with a task 204. At task 204, controller 50 (FIG. 2) determines an appropriate dehumidification mode stage to perform. A task 206 is performed in cooperation with task 204. At task 206, controller 50 selects and initiates execution of a dehumidification mode stage.

In an exemplary configuration, controller 50 selects a desired dehumidification mode stage from one of three operational stages—Stage 1: first dehumidification requirement 208, Stage 2: second dehumidification requirement 210, and Stage 3: third dehumidification requirement 212. Following the initiation of any of stages 208, 210, and 212, at task 206 the desired "stage" of dehumidification will continue in response to the humidity of space 34, as well as the humidity of outdoor air 30. When dehumidification is no longer required, dehumidification mode subprocess 202 exits. Each of stages 208, 210, and 212 is discussed briefly below.

Stage 1: dehumidification requirement 208, supply and return fans 70 and 76, respectively, (FIG. 2) are set to a desired fan speed. For example, supply fan 70 may be set to 5300 cubic-feet-per-minute (cfm) and return fan 76 may be set to 6000 cfm. In addition, first conditioning circuit, circuit A, 26 (FIG. 3) is de-energized. In this instance, reheat valve 144 (FIG. 4) is enabled and modulated. In addition, second conditioning circuit, circuit B, 28 (FIG. 4) is energized and reversing valve 114 (FIG. 4) for second conditioning circuit B 28 is disabled. Thus, execution of Stage 1: dehumidification requirement 208 results in dehumidification mode 152 (FIG. 7).

Stage 2: dehumidification requirement 210, supply and return fans 70 and 76, respectively, (FIG. 2) are set to a desired fan speed. For example, supply fan 70 may be set to 4200 cubic-feet-per-minute (cfm) and return fan 76 may be set to 5000 cfm. In addition, first conditioning circuit, circuit A, 26 (FIG. 3) de-energized and reversing valve 82 (FIG. 3) for first conditioning circuit A 22 is disabled. In this instance, reheat valve 144 (FIG. 4) disabled and second conditioning circuit, circuit B, 28 (FIG. 4) is de-energized. Thus, execution of Stage 2: dehumidification requirement 210 results in no dehumidification occurring, which may be the operational mode when only ventilation is called for at task 168 (FIG. 8) of system control process 154 (FIG. 8).

At Stage 3: dehumidification requirement 212, supply and return fans 70 and 76, respectively, (FIG. 2) are set to a desired fan speed. For example, supply fan 70 may be set to 4200 cubic-feet-per-minute (cfm) and return fan 76 may be set to 5000 cfm. In this instance, reheat valve 144 (FIG. 4) is enabled and modulated. In addition, both first conditioning circuit, circuit A, 26 (FIG. 3) and second conditioning circuit, circuit B, 28 (FIG. 4) are energized and their corresponding reversing valves 82 and 114 are disabled. Thus, execution of Stage 3: dehumidification requirement 198 results in dehumidification mode 152 (FIG. 7).

Figure 12:
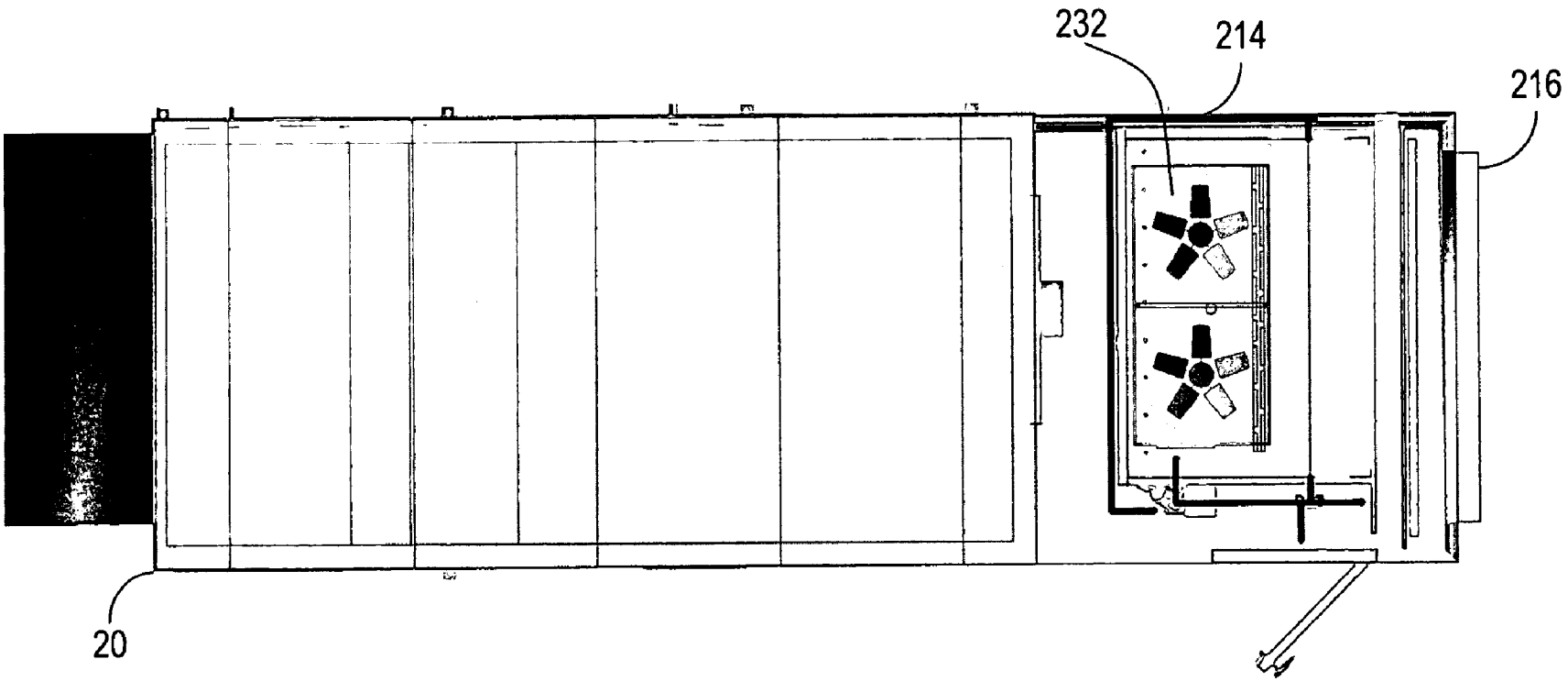
FIG. 12 shows a plan view of a cooling unit attached to the system in FIG. 1.
Figure 13:
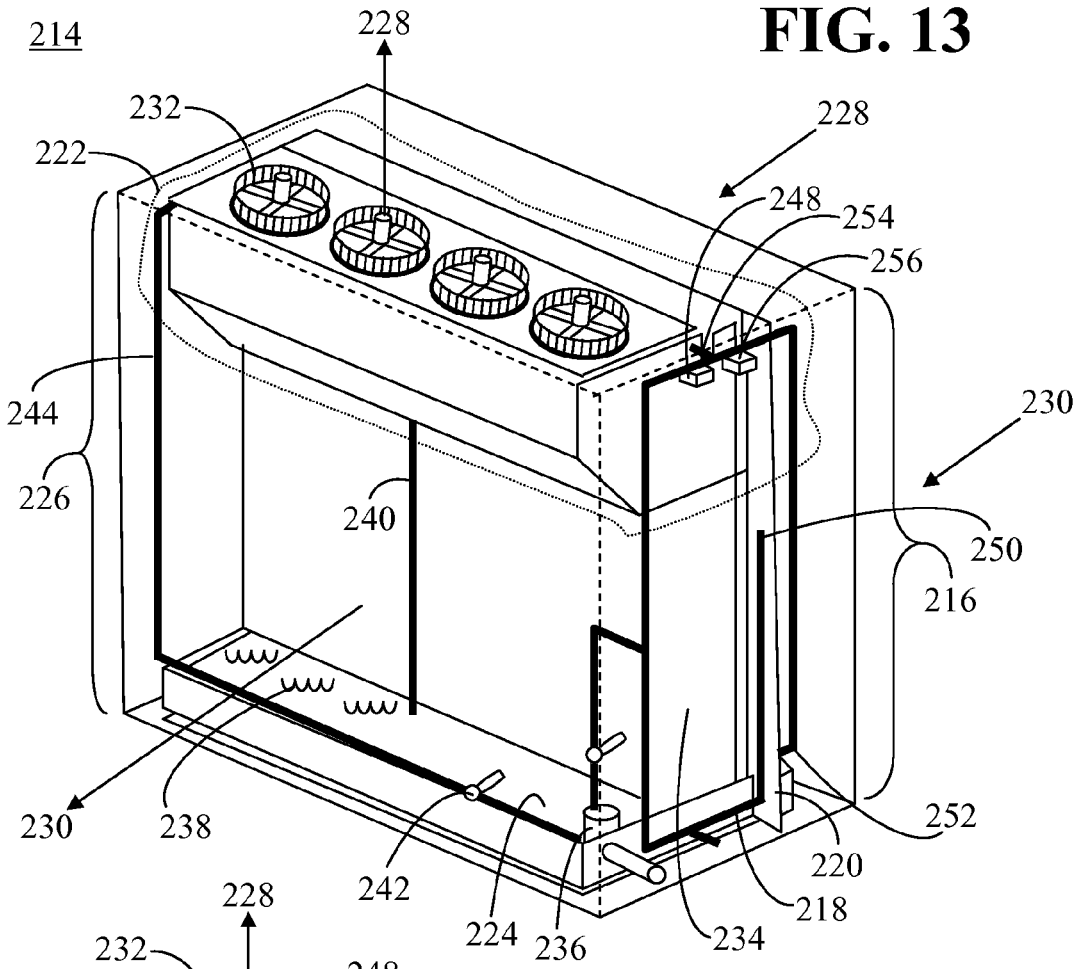
FIG. 13 shows a plan view of a cooling unit attachable to the system in FIG. 1.
Figure 14:
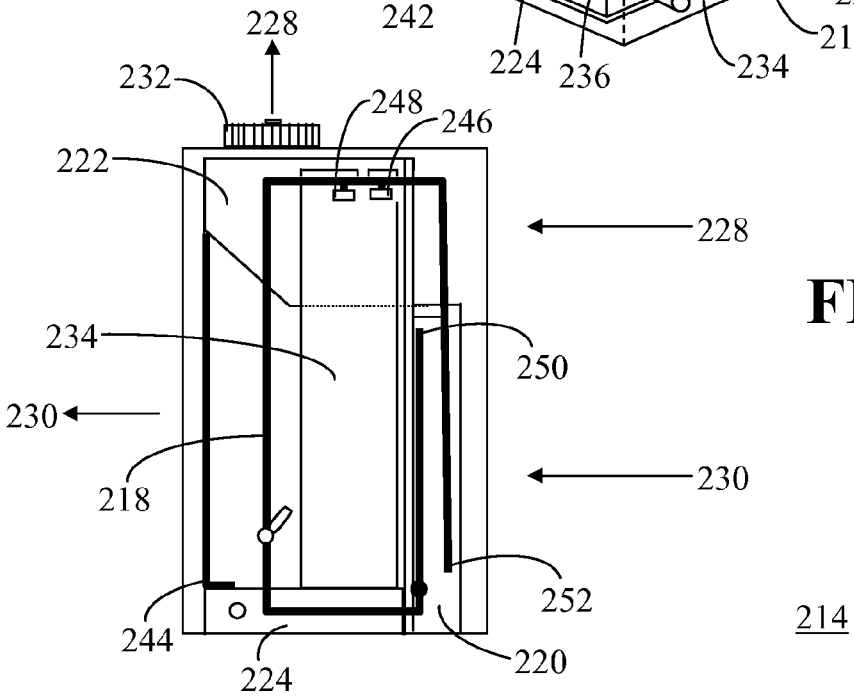
FIG. 14 shows a side view of the cooling unit shown in FIG. 12.

FIGS. 12, 13 and 14 show a cooling section 214 that may be coupled to supply section 22 (FIG. 2). FIG. 12 shows one embodiment in which cooling section 214 is welded to supply section 22, however those skilled in the art will recognize that any method of coupling cooling section 214 and supply section 22 can be used that ensures that there is no interaction between the output of cooling section 214 and air outside of system 20.

Cooling section 214 is an air cooler that pre-conditions the temperature of outside air 30 that enters supply section 22. This pre-conditioning reduces the temperature of the air that enters supply section 22, thus reducing the energy needed to bring the temperature and humidity of outside air 30 to user required humidity and temperature of supply air 36. The temperature reduction in cooling section 214 is done using only the heat in outside air 30, and so will reduce the temperature without increasing energy costs. Although cooling section 214 would be effective when outside air 30 is being cooled before being supplied to inside space 34, it should not be used when outside air 30 must be heated.

Cooling section 214 generally includes a cooling inlet 216, a cooling circuit 218, an indirect exchanger 220, a media exchanger 222, a sump 224 and a cooling outlet 226. Indirect exchanger 220 accepts outside air 30 and directs outside air 30 to cooling outlet 226. While passing through indirect exchanger 220, outside air 30 is cooled by cooling fluid 238 that flows through cooling circuit 218. There is no direct contact between the air flowing through indirect exchanger 220 and outside air 30. In one embodiment, media exchanger 222 is above indirect exchanger 220, isolating the flows of outside air 30 through media exchanger 222 and indirect exchanger 220. Cooling inlet 216 includes a first air path 228 and a second air path 230. First air path 228 passes through media exchanger 222 to a fan 232 and is released out of cooling section 214 to the atmosphere. Second air path 230 passes through indirect exchanger 220.

Cooling circuit 218 includes a pump 236, which pumps cooling fluid 238 from sump 224 through cooling circuit 218 to indirect exchanger 220. In a preferred embodiment, cooling fluid 238 is water, however those skilled in the art will recognize that other heat transporting fluids may be used. Indirect exchanger 220 is a heat exchanger that transfers heat between the air in second air path 230 and cooling fluid 238 to alter the temperature of the air in second air path 230. Indirect exchanger 220 has a cooling fluid input 250 and a cooling fluid output 252. There is no contact between cooling fluid 238 and the air in second air path 230 while the air passes through indirect exchanger 220, thus the air in second air path 230 is indirectly cooled by cooling fluid 238.

From indirect exchanger 222 220, cooling fluid 238 flows within cooling circuit 218 to media exchanger 220 222. Media exchanger 220 222 is a heat exchanger that transfers heat between cooling fluid 238 and the air in first air path 228 to alter the temperature of cooling fluid 238. Cooling fluid 238 enters media exchanger 220 222 at a media exchanger input 254. There is direct contact between cooling fluid 238 and the air in first air path 228 while heat is transferred in media exchanger 220 222. This direct contact reduces the temperature of cooling fluid 238 to within 3 degrees of wet bulb temperature. It is the wet bulb temperature of the air that permits air in first air path 228, having the same temperature as air in second air path 230, to reduce the temperature of cooling fluid 238, while the air in second air path 230 heats cooling fluid 238 in indirect exchanger 222 220. From media exchanger 220 222, cooling fluid 238 returns to sump 224. In one embodiment, cooling fluid 238 is returned to sump 224 through a return pipe 240.

In one embodiment, second air path 230 passes through a direct exchanger 234 after passing through indirect exchanger 220. Direct exchanger 234 is a heat exchanger that transfers heat between the air in second air path 230 and cooling fluid 238 to further alter the temperature of the air in second air path 230. Unlike in indirect exchanger 220, there is contact between cooling fluid 238 and the air in second air path 230 while the air passes through direct exchanger 234, thus altering the humidity level of the air in second air path 230. When direct exchanger 234 is in use, return pipe 240 is removed, and cooling fluid 238 flows from media exchanger 222 to direct exchanger 234 before returning to sump 224. By using direct exchanger 234, the temperature of the air in second air path 230 is brought to a lower level than the temperature was after indirect exchanger 220. However, the humidity level of the air in second air path 230 is increased when the air passes through direct exchanger 234, as the air comes in direct contact with cooling fluid 238.

A flush line 244 directs the flow of cooling fluid 238 from cooling circuit 218 directly to sump 224. Flush line 244 travels along the top of media exchanger 222, directly contacting the surface of media exchanger 222. This permits cooling fluid 238 that flows through flush line 244 to flush out any debris that may be collected along the top surface of media exchanger 222. A flush valve 242 is placed on flush line 244 to regulate when cooling fluid 238 flows through flush line 244. Periodically, flush valve 242 is opened, cooling fluid 238 flows through flush line 244, and the surface of media exchanger 222 is cleared of debris. Cooling fluid 238 that flows through flush line 244 aids in removing any debris that may obstruct the flow through media exchanger 222. Flush line 244 empties into sump 224, returning cooling fluid 238 to be recirculated through cooling circuit 218. In one embodiment, flush valve 242 is opened every hour. However, those skilled in the art will recognize that the rate of opening flush valve 242 may be altered to effectively remove debris as needed.

Cooling circuit 218 also has two flow control valves. A first flow control valve 246 controls the flow of cooling fluid 238 from indirect exchanger 220 to media exchanger 222. As cooling fluid 238 flows through indirect exchanger 220, cooling fluid 238 is heated by air through second air path 230. The flow of this heated cooling fluid 238 to media exchanger 222 is regulated by first flow control valve 246, thus partially regulating the level of flow and temperature of cooling fluid 238 that enters media exchanger 222. A second flow control valve 248 controls the flow of cooling fluid 238 directly from sump 224. Cooling circuit 218 is configured to permit cooling fluid 238 to flow either indirectly to media exchanger 222, through indirect exchanger 220, or directly to media exchanger 222. Second flow control valve 248 regulates the flow of cooling fluid 238 flowing directly to media exchanger 222.

By controlling the flow through both first and second flow control valves 246 and 248, cooling fluid 238 from indirect exchanger 220 is mixed with cooling fluid 238 directly from sump 224 as cooling fluid 238 enters media exchanger 222 for further heat exchange. By changing the flow through first or second flow control valves 246 or 248, the temperature of cooling fluid 238 that enters media exchanger 222 can be altered. Also, by regulating the amount of cooling fluid 238 that flows into media exchanger 222, first and second flow control valves 246 and 248 affect the temperature of cooling fluid 238 in sump 224. This is because the temperature of cooling fluid 238 in sump 224 will decrease if a larger amount of cooled cooling fluid 238 enters sump 224. Regulating the temperature of cooling fluid 238 this way also regulates the temperature of cooling fluid 238 that enters indirect exchanger 220, thus regulating the amount of heat energy that must be transferred in indirect exchanger 220 to ultimately regulate the air in second air path 230.

In summary, the present invention teaches an air conditioning and energy recovery system and a method of controlling the air conditioning and energy recovery system so as to provide effective energy recovery in both the heating and cooling seasons over a full range of temperature (e.g., from one hundred and twenty-two degrees Fahrenheit down to negative ten degrees Fahrenheit). The energy recovery capability is integral to the air conditioning system to enable downsizing of the system relative to prior art heating, ventilation, and air conditioning systems. This downsizing is accomplished through a reduction in peak heating and cooling requirements. Furthermore, the system and associated methodology can be readily implemented in environments that require one hundred percent outside air at high ventilation rates.

Although the preferred embodiments of the invention have been illustrated and described in detail, it will be readily apparent to those skilled in the art that various modifications may be made therein without departing from the spirit of the invention or from the scope of the appended claims. For example, the system can be adapted to include more or less stages of heating mode, cooling mode, and dehumidification mode then that which was described. In addition, various mathematical and intuitive techniques can be used for determining which stage of cooling, heating, and/or dehumidification may be implemented in response to temperature and humidity requirements.

What is claimed is:

1. A system for conditioning air entering an interior space comprising:

a first conditioning circuit for carrying a first fluid, said first conditioning circuit including a first heat exchanger, a second heat exchanger, and a compressor interposed between said first and second heat exchangers;

a supply section having an inlet for receiving air and having an outlet for providing supply air to said interior space, said first heat exchanger residing in said supply section;

a return section having a first inlet for receiving return air from said interior space and an outlet for releasing said return air outside of said interior space, said second heat exchanger residing in said return section;

a controller in communication with said conditioning circuit; and a second conditioning circuit comprising a third heat exchanger, and a second compressor;

wherein:

said third heat exchanger resides in said supply section;

said second conditioning circuit is in fluid communication with said first conditioning circuit; and said controller determines a dehumidification mode and selectively actuates said second conditioning circuit in response to said dehumidification mode.

2. A system for conditioning air entering an interior space comprising:

a conditioning circuit for carrying a fluid, said conditioning circuit including a first heat exchanger, a second heat exchanger, and a compressor interposed between said first and second heat exchangers;

a supply section having an inlet for receiving outside air and having an outlet for providing supply air to said interior space, said first heat exchanger residing in said supply section;

a return section having a first inlet for receiving return air from said interior space and an outlet for releasing said return air outside of said interior space, said second heat exchanger residing in said return section; and a controller in communication with said conditioning circuit.

3. A system for conditioning air entering an interior space comprising:

a conditioning circuit for carrying a fluid, said conditioning circuit including a first heat exchanger, a second heat exchanger, and a compressor interposed between said first and second heat exchangers, wherein a first one of said first and second heat exchangers heats air passing therethrough and a second one of said first and second heat exchangers cools air passing therethrough;

a supply section having an inlet for receiving air and having an outlet for providing supply air to said interior space, said first heat exchanger residing in said supply section;

a return section having a first inlet for receiving return air from said interior space and an outlet for releasing said return air outside of said interior space, said second heat exchanger residing in said return section; and a controller in communication with said conditioning circuit.

4. A system as claimed in claim 3 wherein said first heat exchanger cools air in said supply section and said second heat exchanger heats said return air in said return section.

5. A system as claimed in claim 3 wherein said first heat exchanger heats air in said supply section and said second heat exchanger cools said return air in said return section.

6. A system for conditioning air entering an interior space comprising:

a conditioning circuit for carrying a fluid, said conditioning circuit including a first heat exchanger, a second heat exchanger, and a compressor interposed between said first and second heat exchangers;

a supply section having an inlet for receiving air and having an outlet for providing supply air to said interior space, said first heat exchanger residing in said supply section;

a return section having a first inlet for receiving return air from said interior space and an outlet for releasing said return air outside of said interior space, said second heat exchanger residing in said return section; and a controller in communication with said conditioning circuit; wherein said supply section further comprises:

a cooling inlet comprising a first air path and a second air path, said first and second air paths configured to receive said air;

a cooling circuit for carrying a cooling fluid;

a media exchanger having an input end and an output end, said media exchanger configured to accept said air in said first air path, cool said cooling fluid with said air in said first air path, and release said air in said first air path air from said system;

an indirect exchanger wherein said air in said second air path is cooled by said cooling fluid, and a cooling outlet coupled to said supply section;

wherein said air from said second air path is cooled by said indirect exchanger while passing from said cooling inlet to said cooling outlet for providing said supply air without said supply air coming into contact with said cooling fluid.

7. A system as claimed in claim 6, said cooling section further comprising:

a direct exchanger configured to use said cooling fluid to cool said air in said second air path while said air in said second air path passes through said direct exchanger from said indirect exchanger to said cooling outlet for providing supply air wherein said air in said second air path comes in contact with said cooling fluid in said direct exchanger.

8. A system for conditioning air entering an interior space comprising:

a conditioning circuit for carrying a fluid, said conditioning circuit including a first heat exchanger, a second heat exchanger, and a compressor interposed between said first and second heat exchangers;

a supply section having an inlet for receiving air and having an outlet for providing supply air to said interior space, said first heat exchanger residing in said supply section, said supply section receiving and conditioning only outside air;

a return section having a first inlet for receiving return air from said interior space and an outlet for releasing said return air outside of said interior space, said second heat exchanger residing in said return section; and a controller in communication with said conditioning circuit.

9. A method for conditioning air entering an interior space comprising:

obtaining supply air from outside of said interior space;

exchanging heat between said supply air and a heat transporting fluid in a first heat exchanger;

releasing said supply air into said interior space;

obtaining return air from said interior space;

exchanging heat between said return air and said heat transporting fluid in a second heat exchanger, said heat transporting fluid being circulated between said first and second heat exchangers; and releasing said return air outside of said interior space.

10. A method as described in claim 9 further comprising adjusting a humidity level of said outside air to a desirable setting prior to releasing said outside air into said interior space.

11. A method as described in claim 9 wherein said activity of exchanging heat between said supply air and said heat transporting fluid cools said supply air and said activity of exchanging heat between said return air and said heat transporting fluid heats said return air.

12. A method as described in claim 9 wherein said activity of exchanging heat between said supply air and said heat transporting fluid heats said supply air and said activity of exchanging heat between said return air and said heat transporting fluid cools said return air.

13. A system for conditioning air entering an interior space comprising:

a first conditioning circuit for carrying a first fluid, said conditioning circuit including a first heat exchanger, a second heat exchanger, and a first compressor interposed between said first and second heat exchangers;

a second conditioning circuit for carrying a second fluid, said second conditioning circuit including a third heat exchanger, a fourth heat exchanger, and a second compressor interposed between said third and fourth heat exchangers;

a supply section having a supply inlet for receiving air and having a supply outlet for providing supply air to said interior space;

a return section having a return inlet for receiving return air from said interior space and a return outlet for releasing said return air outside of said interior space; and a controller in communication with said conditioning circuit;

wherein:

said first and third heat exchangers of said first and second conditioning circuits, respectively, reside in said supply section; and said second and fourth heat exchangers of said first and second conditioning circuits, respectively, reside in said return section.

14. A system as claimed in claim 13 further comprising:

a third conditioning circuit comprising a fifth heat exchanger, and a third compressor;

wherein:

said fifth heat exchanger resides in said supply section;

said third conditioning circuit is in communication with said second conditioning circuit; and said controller determines a dehumidification mode and selectively actuates said third conditioning circuit in response to said dehumidification mode.

15. A system as claimed in claim 13 wherein a first one of said first and second heat exchangers heats air passing therethrough and a second one of said first and second heat exchangers cools air passing therethrough.

16. A system as claimed in claim 15 wherein said first heat exchanger and said third heat exchanger cool air in said supply section and said second heat exchanger and said fourth heat exchanger heat said return air in said return section.

17. A system as claimed in claim 16 wherein said first heat exchanger and said third heat exchanger heat air in said supply section and said second heat exchanger and said fourth heat exchanger cool said return air in said return section.

18. A system as claimed in claim 13 further comprising:

a cooling section having:

a cooling inlet comprising a first air path and a second air path, said first and second air paths configured to receive air;

a cooling circuit for carrying a cooling fluid;

a media exchanger having an input end and an output end, said media exchanger configured to accept said air in said first air path, cool said cooling fluid with the air, and release the air from said system;

an indirect exchanger wherein said air in said second air path is cooled by said cooling fluid, and a cooling outlet coupled to said supply section;

wherein said air from said second air path is cooled by said indirect exchanger while passing from said cooling inlet to said cooling outlet for providing said supply air without said supply air coming into contact with said cooling fluid.

19. A system as claimed in claim 18, said cooling section further comprising:

a direct exchanger configured to use said cooling fluid to cool said air in said second air path while said air passes through said direct exchanger from said indirect exchanger to said cooling outlet for providing said supply air wherein said air in said second air path comes in contact with said cooling fluid.

20. A system for conditioning air comprising:

a cooling section having:

a cooling inlet comprising a first air path and a second air path, said first and second air paths configured to receive said air;

a cooling circuit for carrying a cooling fluid;

an indirect exchanger wherein said air in said second air path is cooled by said cooling fluid;

a media exchanger having an input end and an output end, said media exchanger configured to accept said air in said first air path, cool said cooling fluid with the air, and release the air from said system; and a cooling outlet;

wherein a temperature of said air from said second air path is reduced by said indirect exchanger while passing from said cooling inlet to said cooling outlet without said air coming into contact with said cooling fluid.

21. A system as claimed in claim 20 further comprising:

a sump;

wherein said cooling circuit is configured to permit said cooling fluid to pass from said sump to said indirect exchanger, then to said media exchanger, from which said cooling fluid returns to said sump.

22. A system as claimed in claim 20, wherein a flow control valve controls the flow of said cooling fluid to control the reduction of said temperature of said second outside air in said second air path.

23. A system as claimed in claim 20, further comprising a flush line configured to clear said cooling circuit of obstructions.

24. A system as claimed in claim 20, said cooling section further comprising:

a direct exchanger configured to use said cooling fluid to cool said air in said second air path while said air passes through said direct exchanger from said indirect exchanger to said cooling outlet for providing supply air wherein said air in said second air path directly communicates with said cooling fluid in said direct exchanger.

* * * * *